US005699565A

United States Patent [19]

Petterborg

[11] Patent Number: 5,699,565

[45] Date of Patent: Dec. 23, 1997

[54] COLLAPSIBLE BEDSPREAD HOLDER

[76] Inventor: Emil M. Petterborg, 7774 Beltane Dr., San Jose, Calif. 95135

[21] Appl. No.: 723,586

[22] Filed: Oct. 1, 1996

[51] Int. Cl.[6] ..... A47C 21/02

[52] U.S. Cl. ..... 5/504.1; 5/507.1; 108/132

[58] Field of Search ..... 5/504.1, 506.1, 5/507.1; 108/123, 132

[56] References Cited

U.S. PATENT DOCUMENTS

| | | | |
|---|---|---|---|
| 3,435,469 | 4/1969 | Fricke | 5/504.1 |
| 3,961,385 | 6/1976 | Ferry | 5/504.1 |
| 5,001,795 | 3/1991 | Kasten | 5/504.1 |
| 5,305,480 | 4/1994 | Loren et al. | 5/504.1 |
| 5,322,022 | 6/1994 | Burkholder | 108/32 X |
| 5,509,158 | 4/1996 | Morrison | 5/504.1 |

*Primary Examiner*—Michael F. Trettel
*Attorney, Agent, or Firm*—John J. Leavitt

[57] ABSTRACT

The collapsible bedspread holder includes a frame for placement at the "foot" of a bed. It includes metal rods to be "sandwiched" between the mattress and box spring of the bed, with one end of each rod bent up at a 90 degree angle and pivotally and detachably attached to the bedspread holder frame to retain it at the approximate level of the top of the mattress. The other end of each steel rod is attached to one end of a tether the other end of which is connected to an anchor plate abutting the associated ends of the mattress and box spring at the opposite end of the bed. The frame may be deployed from a vertical retracted position in which the bedspread holder is covered by the bedspread and cannot be seen, to a horizontal extended position in which the frame, supported on retractible legs and the steel rods, may support the bedspread when removed from the bed and folded back for storage when the bed is being slept in.

9 Claims, 4 Drawing Sheets

COLLAPSIBLE BEDSPREAD HOLDER

FIELD OF THE INVENTION

The present invention relates to a collapsible bedspread holder, and more particularly to such a structure that is simple to operate and requires a minimum of space in a bedroom except when deployed for use.

DESCRIPTION OF PRIOR ART

U.S. Pat. No. 3,961,385 depicted in FIG. 2, comprises, a collapsible platform mounted to the end of a mattress of a bed for temporarily storing bedspreads or blankets. The structure and mode of operation of this device is significantly different from the invention presented herein.

U.S. Pat. No. 3,435,469 illustrates a bedspread support member that has a flat anchor member inserted between the mattress and box spring, with a holding member that slides under the bed when the unit is not in use pivotally attached to the bedspread support member. Again, the structure and mode of operation of this device is significantly different from the invention presented herein.

Removing and replacing a bedspread from a bed can be both time-consuming and difficult. Some people simply pull the bedspread back and drop it to the floor. Others have chests or other furniture items at the foot of the bed to hold the bedspread pending replacement on the bed. Both of these options have their drawbacks.

Placing a bedspread on the floor creates an obstruction, which can trip a person and cause injury, can be unsanitary and can result in excessive wear on the bedspread. Chests and other items of furniture at the foot of the bed can take up space where space is not always available for easy movement throughout the bedroom.

SUMMARY OF THE INVENTION

In terms of broad inclusion, the invention described and illustrated herein comprises a collapsible bedspread holder including a frame adapted to abut the "foot" of a bed equipped with legs, mattress and box spring. It includes a pair of steel rods adapted to be "sandwiched" between the mattress and box spring with one end of each rod bent up at a 90 degree angle and pivotally and detachably attached to the bedspread holder frame to retain it at the approximate level of the top of the mattress. The other end of each steel rod is attached to one end of a tether the other end of which is connected to an anchor plate operatively disposed at the "head" of the bed and abutting the associated ends of the mattress and box spring. The anchor plates cooperate with the steel rods and tethers to firmly press the frame against the "foot" of the bed, thus facilitating deploying the stand from a vertical retracted position in which the bedspread holder is covered by the bedspread and cannot be seen, to a horizontal extended position in which the frame, supported on retractible legs and the steel rods, may support the bedspread when removed from the bed and folded back for storage when the bed is being slept in, and thereafter deployed back to a vertical collapsed position by retraction of the retractible legs and pivotal deployment to a vertical position when the bedspread is in use to cover the bed and the bedspread holder.

BRIEF DESCRIPTION OF THE DRAWINGS

The invention may be more cleanly understood with reference to the detailed description that follows and the accompanying drawings in which.

DESCRIPTION OF THE PREFERRED EMBODIMENT

Figure 4:
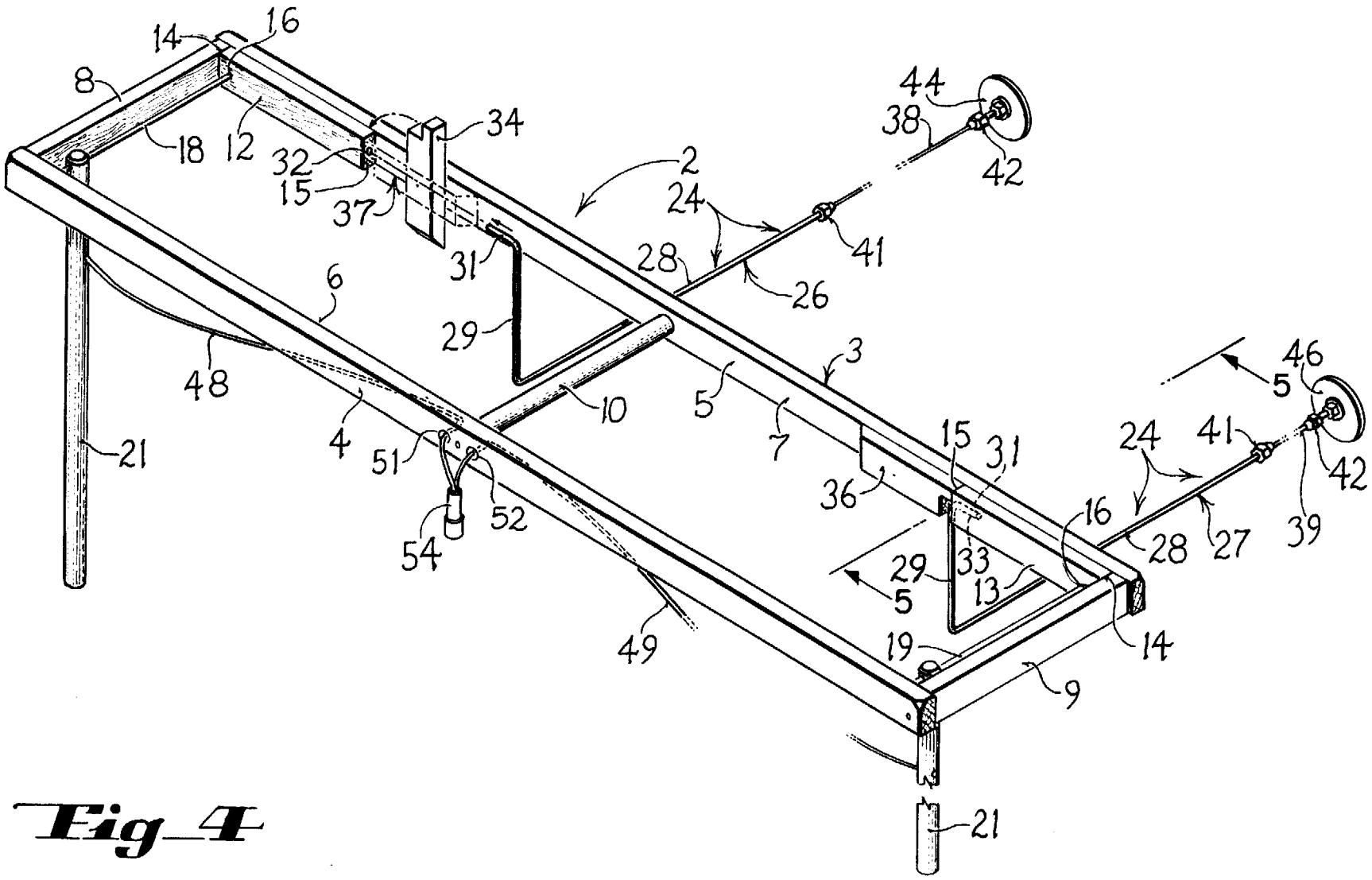
FIG. 4 is a perspective view of the entire assembly of the bedspread holder of my invention, illustrating a partially exploded view of one pivot/anchor rod assembly shown in detached position and associated with a swivel lock in unlatched condition, while the other pivot/anchor rod assembly is shown in locked position.
Figure 5:
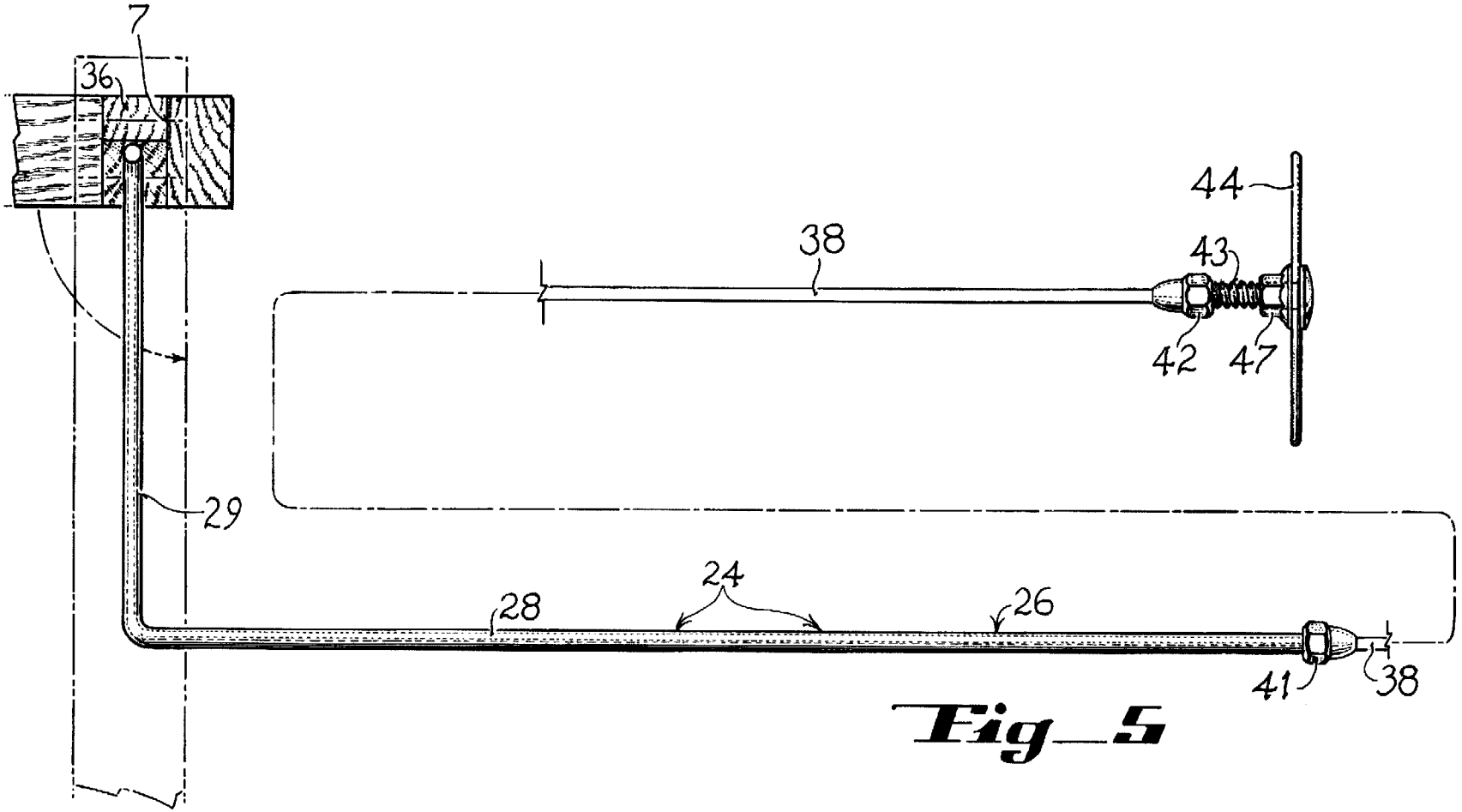
FIG. 5 is a fragmentary vertical sectional view taken in the plane and in the direction indicated, by the arrows 5—5 in FIG. 4.

In terms of greater detail, and referring to FIG. 4 of the drawings, the entire assembly of the bedspread holder is there shown apart from a bed (as in FIG. 1) and designated generally by the numeral 2. The assembly includes a quadrilateral frame designated generally by the numeral 3, and includes an elongated front support beam 4 having a length of about the width of the mattress to which it will ultimately be operatively associated. The frame 3 also includes a rear support beam 5 equal in length to the beam 4, and spaced laterally therefrom about 12" and parallel thereto. The front and rear beams 4 and 5 lie in a common plane, and are provided with confronting surfaces 6 and 7, respectively, as shown.

To complete the quadrilateral frame 3, end cross beams 8 and 9 are provided associated with opposite end portions of beams 4 and 5 and having their ends securely anchored to the confronting surfaces. 6 and 7 thereof to form a rigid quadrilateral frame 3 having spaced and parallel front and rear beams connected by spaced and parallel end cross beams as illustrated. Additional rigidity is provided the frame by placement of a center cross beam 10 medianly between and parallel to the end cross beams and anchored at each opposite end to the confronting surfaces 6 and 7 of the front and rear beams of the frame.

Fixed in parallel juxtaposition to the surface 7 of rear beam 5 adjacent opposite ends thereof are pintle anchor blocks 12 and 13, each comprising an elongated block, conveniently wood, and each having corresponding first and second ends 14 and 15. The corresponding first ends 14 of each pintle anchor block abut the associated end cross beams 8 and 9, while the corresponding second ends 15 of the pintle anchor blocks confront one another in spaced relation, the end 15 of each pintle anchor block being spaced from the associated end cross beam a distance of about 8".

Formed in each pintle anchor block medianly between its top and bottom surfaces, and spaced from said first end 14 approximately 1", is a through-bore 16. Formed in the front support beam 4, in axial alignment with each through-bore 16, is a complementary bore 17 that penetrates the front beam 4 to a depth of about one-half its thickness. Mounted in the aligned pairs of bores 16 and 17 at opposite ends of the frame are parallel pintle rods 18 and 19 that extend transversely across the frame, each parallel to the associated end cross beam and spaced approximately 1" therefrom.

Figure 6:
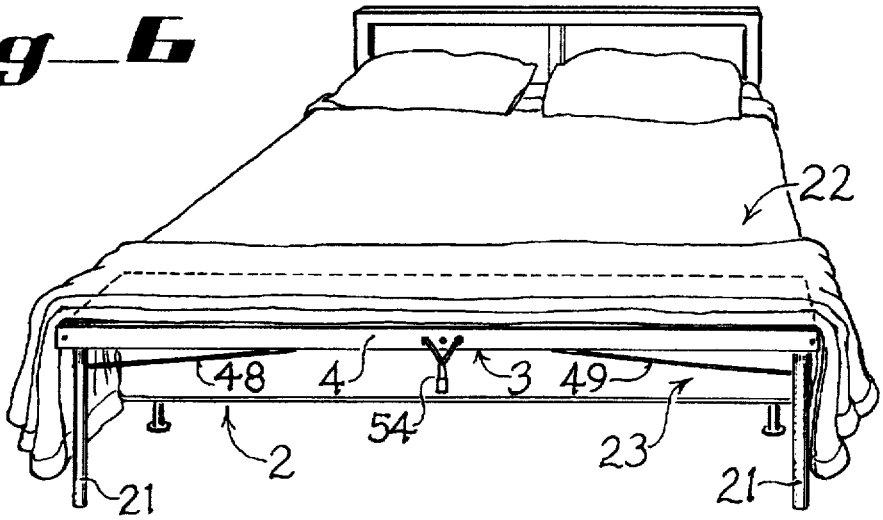
FIG. 6 is a perspective view of a bed with a bedspread supported on the bedspread holder.

It should be noted that for assembly, one end of each pintle rod is inserted through the associated through-bore 16 while the opposite end of the pintle rod is inserted through a transverse complementary bore adjacent one end of a leg 21 and then inserted full depth into the axially aligned bore 17 in front beam 4. The pintle anchor block is then attached to the rear beam 5, thus trapping the pintle rod between the bottom of bore 17 in front beam 4 and the surface 7 of rear beam 5. Consequently, each leg 21 is thus pivotally mounted on the associated pintle nod and selectively moveable 90 degrees between a first position in which it lies juxtaposed and parallel to the front and rear beams 4 and 5 when the bedspread holder is collapsed, to a second position in which each leg extends perpendicular to the front and rear beam 4 and 5 when the assembly is in bedspread supporting position as shown in FIGS. 1, 4 and 6.

Figure 1:
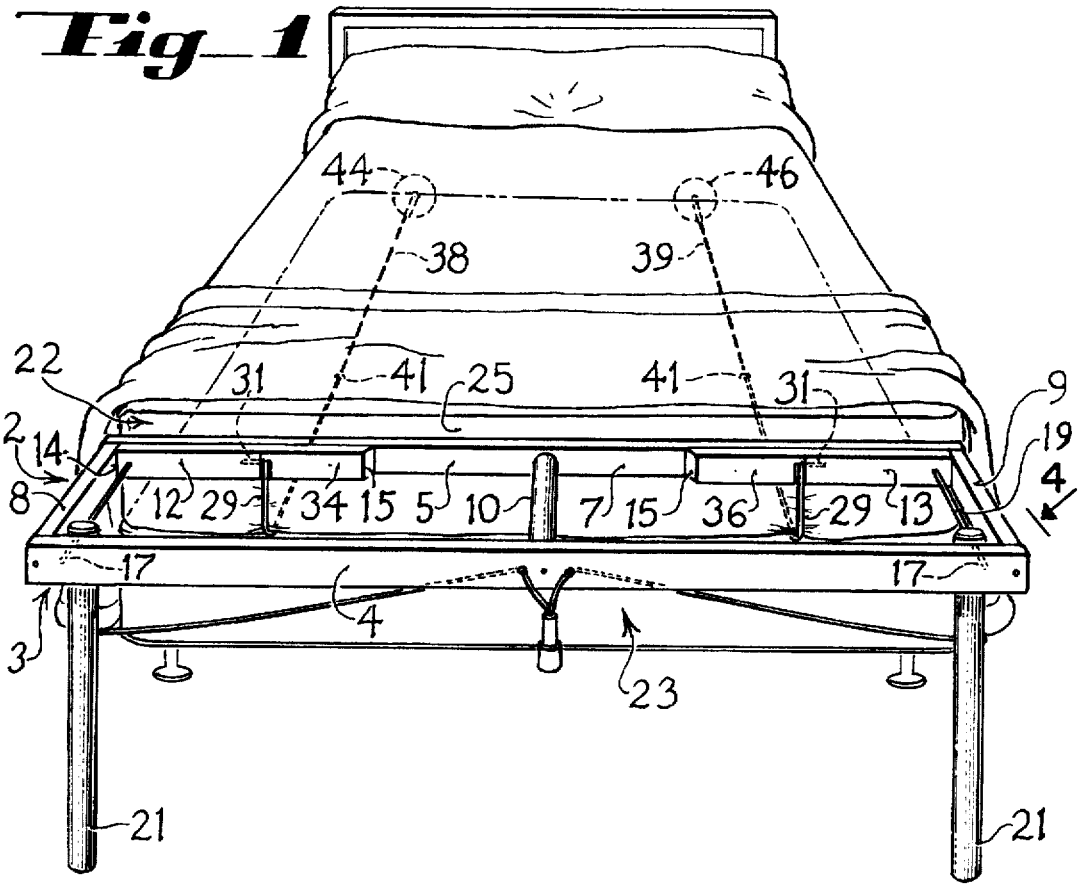
FIG. 1 is a perspective view of a bed with the collapsible bedspread holder installed and deployed in position of use to support a bedspread.
Figure 2:
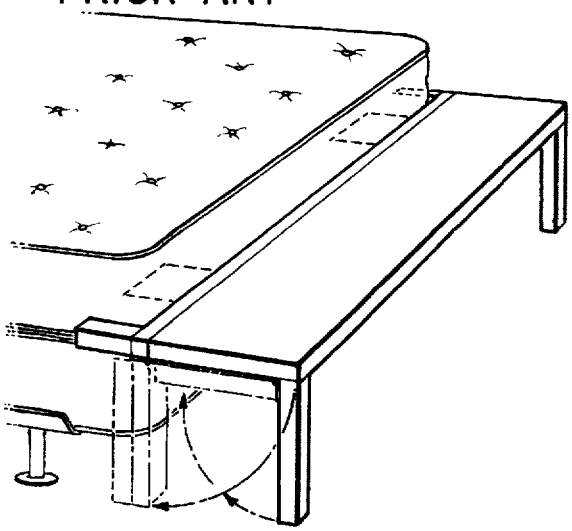
Fig 2 PRIOR ART
FIG. 2 illustrates the bedspread holder disclosed in U.S. Pat. No. 3,961,385.
Figure 3:
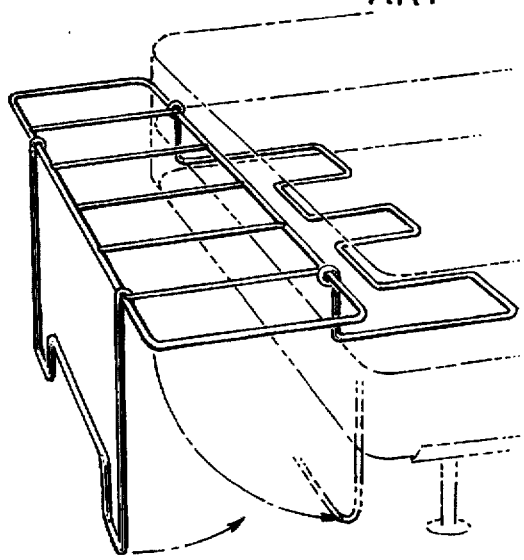
Fig 3 PRIOR ART
FIG. 3 illustrates the bedspread holder disclosed in U.S. Pat. No. 3,435,469.

To detachably secure the bedspread support frame thus described and illustrated in a position of functional cooperative association with a mattress 22 and box spring 23, there is provided an anchor assembly designated generally by the numeral 24 which, when mounted as illustrated in FIG. 1, places and retains the rear beam 5 of the frame firmly abutted against the "foot" end 25 of mattress 22.

Referring to FIG. 4, the anchor assembly 24 comprises a pair of anchor rods designated generally by the numerals 26 and 27 which may conveniently be formed from metal or appropriate synthetic resinous material commonly known as "plastic". Each anchor rod includes a main body portion 28. One end portion 29 of the main body portion of each anchor rod, for a length of about 6", is perpendicular to the main body 28 of the anchor rod and lies in the same plane, which is generally perpendicular to the rear beam 5. Each perpendicular end portion 29 in an end portion. remote from the main body of the anchor rod is formed with a pivot portion 31 that extends perpendicular to the end portion 29 and thus perpendicular to the plane within which the main body and end portion are coincident, and thus parallel to the associated rear beam 5 when assembled to the frame.

From FIG. 4 it should be noted that the pivot portions 31 of the anchor rods 26 and 27 extend in opposite directions when the main bodies 28 of these anchor rods lie parallel to one another as shown. The reason for this "left" and "right" configuration of the anchor rods 26 and 27 is that the anchor rod 26 is pivotally mounted on pintle anchor block 12 by insertion of the pivot portion 31 of that anchor rod into a bore 32 formed in the end face 15 of pintle anchor block 12.

To effect such pivotal interconnection, the pivot portion 31 must lie parallel to the beam 5 and extend toward the end cross beam 8. In contrast, the pivot portion 31 of anchor rod 27 must extend toward the end cross beam 9, i.e., in a direction opposite to the direction of extension of the pivot portion 31 on anchor rod 26, while lying parallel to the rear beam 5, so that it may be inserted for pivotal rotation in a bore 33 formed in the end face 15 of pintle anchor block 13. It should be noted that the bores 32 and 33 that pivotally receive the pivot portions 31 are axially aligned and parallel to the associated rear beam 5.

After having inserted the pivot portions 31 of each anchor rod into their respective bores in pintle anchor blocks 12 and 13, each pivot portion is selectively locked in place against inadvertent withdrawal by manipulation of independently pivotally mounted latch mechanisms 34 and 36 mounted on the rear beam in operative association with pivot potions 31 of anchor rods 26 and 27. Each latch mechanism 34 and 36 is elongated and pivoted medianly of its length on the associated face 7 of the rear beam. When it is pivoted through 90 degrees to a position perpendicular to the beam 5, there is provided a gap 37 through which the associated pivot portion 31 is aligned with the bore 32 and 33 for insertion into or removal from the associated bore.

After insertion of each pivot portion 31 in its respective bore 32 or 33, each latch mechanism 34 and 36 is pivoted into axial alignment with the associated pintle anchor block, as shown by latch mechanism 36, so that each pivot portion lies trapped against axial displacement but is permitted relative rotation in its complementary bore.

The anchor assembly 24, in addition to the anchor rods 26 and 27, also include flexible and preferably elastic tethers 38 and 39 connected, respectively, to the threaded ends of the main body portions 28 of the anchor rods by "Acorn" nuts 41 threaded onto the threaded end of each rod. Each acorn nut has an aperture in its opposite end through which the end of the tether may pass, but the aperture is not large enough to permit passage of a knot tied in the end portion of the tether residing within the acorn nut. The other end of each tether is similarly anchored in an acorn nut 42 which is in turn threaded onto an associated carriage bolt 43. Anchor plates 44 and 46 are attached to the associated carriage bolts by appropriate lock nuts 47 as shown in FIG. 4.

It will thus be seen that by "sandwiching" the main body portions 28 of the anchor rods 26 and 27 and the attached tethers 38 and 39 between the under side of the mattress 22 and the top surface of the box spring, the tethers may be pulled taut and even stretched as needed to place the circular anchor plates 44 and 46 in abutting relationship with the "head" end of the mattress and box spring to draw the rear beam 5 of the frame into snug engagement with the "foot" end of the mattress.

Since the legs 21 are pivoted by one end on the associated pintle rods, it will be understood that gravity will cause the legs to be automatically deployed into vertical position as shown in FIGS. 1, 4 and 6 when the frame is deployed to a horizontal bedspread support position. In this position, the 20 legs support the front beam 4 at the same elevation as the rear beam, the elevation of which is controlled by the vertical length of the two end portions 29, both of which are dimensioned in length to place the top surface of the rear beam 5 in approximate correspondence with the top surface of the mattress as shown in FIG. 1.

Means are provided selectively manipulable to effect collapse of the bedspread holder to a vertical position when it is desired to spread the bedspread over the bed. Such means include flexible tethers or lanyards 48 and 49 which pass slidably through apertures 51 and 52 disposed on opposite sides of the center cross beam 10 fastened medianly between the front and rear beams 4 and 5 as shown.

Figure 7:
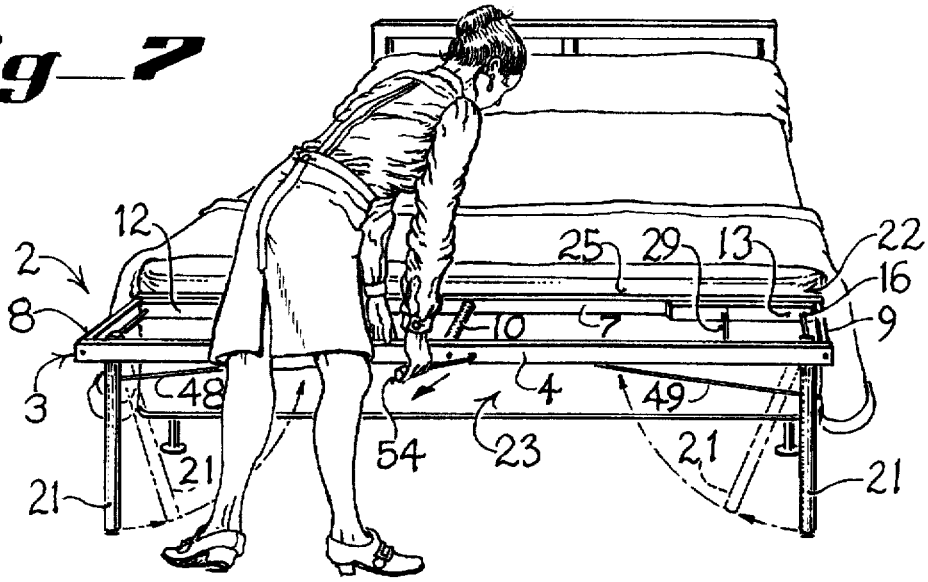
FIG. 7 is a perspective view of a person deploying the bedspread holder to a collapsed condition.

The associated ends of the tethers 48 and 49 are gathered together and attached to a handle 54, while the opposite end of each tether extends to and is anchored to one of the legs 21 at a point below the frame as shown. The length of each leg between the point of attachment of each tether to the associated leg and the pivot point about the pintle rods 18 and 19 constitute lever arms which function to pivot both legs 21 inwardly toward each other as shown in FIG. 7 when the handle 54 is grasped and the tethers 48 and 49 tensioned.

Figure 8:
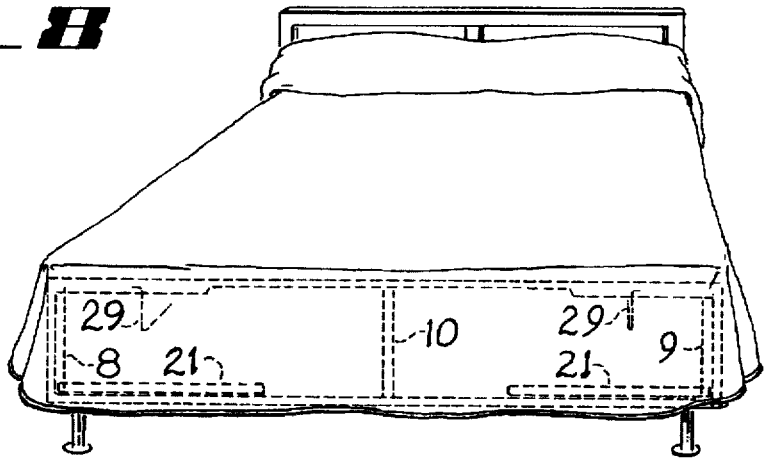
FIG. 8 is a perspective view of a bed with the bedspread covering the collapsed bedspread holder, which is indicated by broken lines.

Thus, while the beam 4 is held by one hand, the handle may be pulled by the other, causing the legs to assume a position parallel and juxtaposed to the surface 6 of the front beam. The front beam is then lowered, causing the frame to pivot on pivot portions 31 until the frame lies in a vertical position as shown in broken lines in FIG. 8. The bedspread is then extended over the end of the bed and over the now collapsed bedspread holder, which remains hidden and unseen under the overlying bedspread.

It will of course be apparent that obvious modifications may be made to the structure illustrated and described that are substantially similar or equivalent to the structure illustrated and described and which function in substantially the same way to produce the same result. It is submitted that all such modifications are within the spirit and scope of the invention disclosed and claimed herein.

Having thus described the invention, what is believed to be new and novel and sought to be protected by letters patent of the United States is as follows.

I claim:

1. A collapsible bedspread holder for use in association with a bed supported on a floor and including a bedspread, a mattress having top and bottom surfaces, and a box spring having a top surface normally contiguous to the bottom surface of said mattress, said holder being selectively deployable for supporting the bedspread when not in use to cover the bed, end said bedspread holder being adapted to be operatively positioned at one end of the bed and selectively collapsible thereat to be covered by said bedspread when said bedspread is applied to cover the bed, said bedspread holder comprising:

a) a quadrilateral frame selectively deployable between a horizontal bedspread support position and a collapsed vertical position;

b) means for pivotally anchoring said quadrilateral frame in close juxtaposition to the said one end of the bed at an elevation approximately corresponding to the height of the top surface of the mattress: and c) means including a pair of independent legs independently pivotally mounted on said frame and deployable to extend perpendicularly between said frame and the floor when said frame is in said horizontal bedspread support position and selectively pivotally deployable inwardly toward each other to lie horizontally substantially parallel to the floor in juxtaposition to said frame and spaced from said floor when said frame is in collapsed vertical position.

2. The collapsible bedspread holder according to claim 1; wherein said quadrilateral frame is fabricated from wood.

3. The collapsible bedspread holder according to claim 2, wherein said means for pivotally anchoring said quadrilateral frame in close juxtaposition to one end of the bed includes a pair of spaced and parallel anchor rods adapted to be disposed between the underside of the mattress and the top of the box spring.

4. The collapsible bedspread holder according to claim 3, wherein each said anchor rod includes a main body portion adapted to be disposed between said mattress and box spring, a right angle portion integral with said main body portion and abutting one end of the mattress, and a pivot portion integral with the right angle portion and perpendicular thereto and to the main body portions of the anchor rods.

5. A collapsible bedspread holder for use in association with a bed supported on a floor and including a bedspread, a mattress having top and bottom surfaces, and a box spring having a top surface normally contiguous to the bottom surface of said mattress, said holder being selectively deployable for supporting the bedspread when not in use to cover the bed, and said bedspread holder being adapted to be operatively positioned at one end of the bed and selectively collapsible thereat to be covered by said bedspread when said bedspread is applied to cover the bed, said bedspread holder comprising:

a) a quadrilateral frame selectively deployable between a horizontal bedspread support position and a collapsed vertical position;

b) means for pivotally anchoring said quadrilateral frame in close juxtaposition to the said one end of the bed at an elevation approximately corresponding to the height of the top surface of the mattress;

c) means including a pair of legs pivotally mounted on said frame and deployable to extend perpendicularly between said frame and the floor when said frame is in said horizontal bedspread support position and selectively deployable to lie horizontally substantially parallel to the floor when said frame is in collapsed vertical position;

d) wherein said quadrilateral frame is fabricated from wood;

e) wherein said means for pivotally anchoring said quadrilateral frame in close juxtaposition to one end of the bed includes a pair of spaced and parallel anchor rods adapted to be disposed between the underside of the mattress and the top of the box spring:

f) wherein each said anchor rod includes a main body portion adapted to he disposed between said mattress and box spring, a right angle portion integral with said main body portion and abutting one end of the mattress, and a pivot portion integral with the right angle portion and perpendicular thereto and to the main body portions of the anchor rods: and g) wherein said pivot portions integral with the associated right angle portions of said anchor rods extend in opposite directions: and means are provided on said quadrilateral frame to pivotally receive said pivot portions whereby said quadrilateral frame may be selectively pivoted on said pivot portions between a horizontal position of use and a vertical collapsed porition of disuse.

6. The collapsible bedspread holder according to claim 5, wherein latch means are provided operatively mounted on said quadrilateral frame in association with said pivot portions and selectively manipulable to lock said pivot portions to said frame against axial displacement in relation thereto.

7. A collapsible bedspread holder for use in association with a bed supported on a floor and including a bedspread, a mattress having top and bottom surfaces, and a box spring having a top surface normally contiguous to the bottom surface of said mattress, said holder being selectively deployable for supporting the bedspread when not in use to cover the bed, and said bedspread holder being adapted to be operatively positioned at one end of the bed and selectively collapsible thereat to be covered by said bedspread when said bedspread is applied to cover the bed, said bedspread holder comprising:

a) a quadrilateral frame selectively deployable between a horizontal bedspread support position and a collapsed vertical position;

b) means for pivotally anchoring said quadrilateral frame in close juxtaposition to the said one end of the bed at an elevation approximately corresponding to the height of the top surface of the mattress;

c) means including a pair of legs pivotally mounted on said frame and deployable to extend perpendicularly between said frame and the floor when said frame is in said horizontal bedspread support position and selectively deployable to lie horizontally substantially parallel to the floor when said frame is in collapsed vertical position;

d) wherein said quadrilateral frame is fabricated from wood;

e) wherein said means for pivotally anchoring said quadrilateral frame in close juxtaposition to one end of the bed includes a pair of spaced and parallel anchor rods adapted to be disposed between the underside of the mattress and the top of the box spring;

f) wherein each said anchor rod includes a main body portion adapted to be disposed between said mattress and box spring, a right angle portion integral with said main body portion and abutting one end of the mattress, and a pivot portion integral with the right angle portion and perpendicular thereto and to the main body portions of the anchor rods; and g) wherein said means for pivotally anchoring said quadrilateral frame in close juxtaposition to one end of the bed includes a tether attached to the end of each anchor rod remote from said right angle portion and adapted to extend axially therefrom between the underside of the mattress and the top surface of the box spring, and means attached to the end of each tether remote from the anchor rod and adapted to abut the opposite end of the bed from said right angle portions whereby said right angle portion of each anchor rod is retained snugly abutting the associated end of the mattress.

8. A collapsible bedspread holder for use in association with a bed supported on a floor and including a bedspread, a mattress having top and bottom surfaces, and a box spring having a top surface normally contiguous to the bottom surface of said mattress, said holder being selectively deployable for supporting the bedspread when not in use to cover the bed, and said bedspread holder being adapted to be operatively positioned at one end of the bed and selectively collapsible thereat to be covered by said bedspread when said bedspread is applied to cover the bed, said bedspread holder comprising:

a) a quadrilateral frame selectively deployable between a horizontal bedspread support position and a collapsed vertical position:

b) means for pivotally anchoring said quadrilateral frame in close juxtaposition to the said one end of the bed at an elevation approximately corresponding to the height of the top surface of the mattress:

c) means including a pair of legs pivotally mounted on said frame and deployable to extend perpendicularly between said frame and the floor when said frame is in said horizontal bedspread support position and selectively deployable to lie horizontally substantially parallel to the floor when said frame is in collapsed vertical position: and d) wherein said quadrilateral frame includes spaced and parallel front and rear beams and spaced and parallel end beams joining opposite ends of said front and rear beams, pivot rods mounted on opposite end portions of said frame spaced and parallel to said end beams, said pair of legs being pivotally mounted on said pivot rods adjacent said front beam for pivotal movement between a position of use that is perpendicular to said front beam and a position of disuse which is parallel to said front beam, and means mounted on said front beam connected to said legs and selectively manipulable to pivot said legs from said position of use to said position of disuse.

9. The collapsible bedspread holder according to claim 8, wherein said means manipulable to pivot said legs from said position of use to said position of disuse includes a pair of lanyards slidably mounted on said front beam and each connected at one end to an associated leg and the opposite ends thereof joined together, whereby tension applied to said lanyards when said pair of legs are in vertical position of use will retract said pair of legs into a horizontal position of disuse.

* * * * *